US009457397B2

(12) United States Patent
Dagner et al.

(10) Patent No.: US 9,457,397 B2
(45) Date of Patent: Oct. 4, 2016

(54) ROLL CASTING METHOD WITH CRYOGENIC COOLING OF CASTING ROLLS

(75) Inventors: Johannes Dagner, Erlangen (DE); Thomas Matschullat, Eckental (DE); Günther Winder, Neunkirchen/Brand (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/351,347

(22) PCT Filed: Jul. 10, 2012

(86) PCT No.: PCT/EP2012/063451

§ 371 (c)(1),
(2), (4) Date: Apr. 11, 2014

(87) PCT Pub. No.: WO2013/053506

PCT Pub. Date: Apr. 18, 2013

(65) Prior Publication Data

US 2014/0290898 A1 Oct. 2, 2014

(30) Foreign Application Priority Data

Oct. 12, 2011 (EP) ..... 11184849

(51) Int. Cl.
*B22D 11/06* (2006.01)
*B22D 11/22* (2006.01)

(52) U.S. Cl.
CPC ..... *B22D 11/06* (2013.01); *B22D 11/0622* (2013.01); *B22D 11/0682* (2013.01); *B22D 11/22* (2013.01)

(58) Field of Classification Search
CPC ... B22D 11/00; B22D 11/049; B22D 11/055; B22D 11/068; B22D 11/0682; B22D 11/124; B22D 11/1241; B22D 11/1245; B22D 11/1246; B22D 11/06; B22D 11/0622
USPC ..... 164/455, 458, 486, 487, 428, 442–444, 164/475, 415
See application file for complete search history.

(56) References Cited

U.S. PATENT DOCUMENTS 3,771,584 A * 11/1973 Wojcik ..... 164/455
4,565,240 A 1/1986 Shibuya et al.

(Continued)

FOREIGN PATENT DOCUMENTS

CN 1363429 8/2002
CN 1681613 10/2005

(Continued)

OTHER PUBLICATIONS

English Machine Translation of abstraact of JP-58-097467. Published Jun. 9, 1983.*

(Continued)

*Primary Examiner* — Kevin P Kerns
*Assistant Examiner* — Steven Ha
(74) *Attorney, Agent, or Firm* — Slayden Grubert Beard PLLC

(57) ABSTRACT

Molten metal poured into a mold region, delimited by a first casting roll that rotates about a first rotational axis, produces a metal strand upon solidification which is conveyed out of the mold region. A liquid coolant is applied to the surface of the first casting roll by a first cooling device via first coolant lines and first coolant applying devices. The coolant is inert with respect to the molten metal and has a standard boiling point below 20° C., e.g., −20° C., at normal air pressure, and an operating temperature at or below an operating boiling point at an operating pressure at which the coolant is supplied. A control device automatically controls the first cooling device by ascertaining a control state of the first cooling device using a target property for an actual property of the first casting roll or the metal strand detected by at least one sensor.

14 Claims, 3 Drawing Sheets

(56) References Cited

U.S. PATENT DOCUMENTS

| | | | | |
|---|---|---|---|---|
| 4,934,444 | A | 6/1990 | Frischknecht et al. | |
| 5,149,488 | A | 9/1992 | Dickson | |
| 5,787,967 | A | 8/1998 | Vendeville et al. | |
| 6,125,915 | A * | 10/2000 | Roder et al. | 164/121 |
| 6,886,623 | B2 | 5/2005 | Kato et al. | |
| 7,156,153 | B2 | 1/2007 | Hohenbichler et al. | |
| 7,891,407 | B2 * | 2/2011 | Schlichting et al. | 164/452 |
| 2003/0232228 | A1 * | 12/2003 | Grasso | 429/26 |
| 2004/0220647 | A1 * | 11/2004 | Noda | 607/105 |
| 2006/0237162 | A1 | 10/2006 | Schlichting et al. | |
| 2010/0064722 | A1 * | 3/2010 | Taras | F24F 3/153 62/498 |
| 2011/0005285 | A1 * | 1/2011 | Otsuka et al. | 72/8.9 |

FOREIGN PATENT DOCUMENTS

| | | | | |
|---|---|---|---|---|
| EP | 0 313 516 | A1 | 4/1989 | |
| EP | 0 436 350 | A1 | 7/1991 | |
| EP | 0736350 | B1 | 9/2001 | |
| EP | 11184849 | | 10/2011 | |
| JP | 56-1250 | | 1/1981 | |
| JP | 58097467 | A * | 6/1983 | |
| JP | 61017344 | A | 1/1986 | B22D 11/06 |

OTHER PUBLICATIONS

English abstract of Yukimoto et al. JP-58-097467.*
English translation of JP-58-097467.*
EP Search Report for Application No. 1184849.5 dated Jan. 31, 2012.
International Search Report for PCT/EP2012/063451 mailed Nov. 13, 2012.
Office Action issued Jan. 23, 2015 in corresponding Chinese Patent Application No. 201280050281.0.
European Office Action dated May 4, 2015 in related European Patent Application No. 12740923.3.
European Office Action, Application No. 12740923.3, 6 pages, Jul. 4, 2016.

* cited by examiner

ROLL CASTING METHOD WITH CRYOGENIC COOLING OF CASTING ROLLS

CROSS REFERENCE TO RELATED APPLICATIONS

This application is the U.S. national stage of International European Application No. PCT/EP2012/063451, filed Jul. 10, 2012 and claims the benefit thereof. The International Application claims the benefit of European Application No. 11184849.5 filed on Oct. 12, 2011, both applications are incorporated by reference herein in their entirety.

BACKGROUND

Described below is a roll casting method, wherein, in a mold region, which is delimited on at least one side by a first casting roll rotating around a horizontal first axis of rotation, molten metal is cast and a metal strand which is produced by the solidification of the molten metal is conveyed out of the mold region, wherein a liquid coolant is applied to the surface of the first casting roll via a first cooling device by a number of first coolant applying devices, wherein the cooling medium is fed to the first coolant applying devices via first coolant applying lines, wherein the cooling medium is inert with respect to the molten metal, has a standard boiling point related to normal air pressure of below 20° C.—especially of below −20° C.—and has an operating temperature which lies at an operating boiling point or lower, wherein the operating boiling point relates to an operating pressure with which the cooling medium is applied.

Such casting methods and the associated apparatus are generally known. Purely by way of example the reader is referred to JP 58 097 467 A.

When metals are cast to close to their final dimensions with a horizontal or vertical single-roll or two-roll casting machine or a strip casting system with casting thickness of below 15 mm, during the shaping of the metal strand which follows on from the casting, the influencing of profile and flatness of the end product is only still possible to a restricted extent. For this reason it is of advantage to already give the cast metal strand a suitable thickness profile or thickness contour during the casting process and in doing so avoid inter alia a tapering thickness if possible.

For influencing the cast profile with two-roll strip casting machines, use is made inter alia of the known fact that the cast strip thickness significantly depends on the flow of heat over the casting roll surface and the contact time. The two factors together determine how thick the strip shell can be at the location concerned. By variation of these variables over the casting roll width the thickness profile of the cast metal strand can thus be influenced to a significant extent.

The contour of the casting roll and the setting (position and/or downward pressure) of the casting roll itself have a further influence on the thickness profile of the strip. The contour of the casting roll in the casting gap is influenced by the thermal expansion and thus in turn by the local flow of heat.

The flow of heat over the casting roll surface is determined on one hand by the thermal transfer coefficient from the molten metal to the casting roll and to an even greater extent by the thermal transfer coefficient from the solidified strand shell to the casting roll. Furthermore the temperature difference between casting roll and strand shell or melt bath is decisive for the flow of heat.

The temperature of the casting roll is usually set in the related art by internal cooling—if necessary supplemented by external cooling. The contact time is determined by the rotational speed of the casting roll, the casting roll geometry and the mold level. When the melt bath surface is calm the contact time is constant in a first approximation over the width of the cast strand. Thus only the heat flow remains as a possible adjustment variable to influence the strand shell thickness and the roll geometry over the strand width.

It is already known that the heat flow over the strand width can be varied by influencing the thermal transition coefficient between the liquid metal or the strand shell and the casting roll. For example a gas with a high thermal conductivity can be dispensed segment-by-segment. Gas mixtures such as argon or nitrogen can also be used, of which components react chemically with the strip shell. In such cases the dispensing facility for the corresponding gas must be disposed in the vicinity of the triple point of molten metal, roll and gas space, in order to be able to bring the gas between the strand shell which forms and the casting roll. In this area of the roll casting system however space is very limited as a result of the arrangement of intermediate pans, molten metal distributors and sensors. This makes the construction and integration expensive, in many cases even impossible.

It is also known that the temperature of the cast roll can be influenced in a segmented manner by an additional liquid coolant applied externally to the cast roll. If water is to be used here it must be ensured however that no water or steam comes into contact with the molten metal. This is in particular because—depending on the metal used—this can result in quality problems or even serious disruptions (for example formation of hydrogen with the associated danger of explosion with non-ferrous metals). Suction and recovery devices taking up large volumes of space are therefore required in such cases.

SUMMARY

The roll casting method provides operationally-safe cooling of the first casting roll in a simple and efficient manner.

The roll casting method uses at least one sensor to detect an actual property of the first casting roll or an actual property of the metal strand can be detected, the actual property is fed to a control device of the cooling device and the controlling device, as a function of the actual property fed to it and a corresponding target property, automatically determines an activation state of the first cooling device and activates the first cooling device accordingly. Through this embodiment a closed control loop is able to be realized in a simple manner.

Often the mold region is delimited on a second side by a second casting roll rotating around a second horizontal axis of rotation. The second axis of rotation runs in this case in parallel to the first axis of rotation. The first and the second casting roll form a casting gap between them. The metal strand is conveyed downwards out of the mold region. In this case, related to the first axis of rotation and viewed in the direction of rotation of the first casting roll, an angle from the casting gap of the mold region to an application location at which the liquid coolant is applied to the surface of the first casting roll may be between 60° and 180°, especially between 90° and 180°.

In an embodiment, there is provision for the first coolant applying devices to be disposed below the first casting roll in an area which, viewed in the horizontal direction, extends over the diameter of the first casting roll and, viewed in a vertical direction, lies below the lowest point of the first casting roll.

In another embodiment, the metal strand is thermally screened from the coolant and/or the first coolant applying devices by a screening device disposed between the metal strand and the coolant applying devices.

The first coolant lines may be jacketed with thermal insulation. This achieves a thermal protection against the ambient temperature. This protection is all the more important the lower the boiling point of the coolant lies and the longer it takes to transport the coolant from a reservoir container to the first coolant applying devices.

Gas separators may be disposed in the first coolant lines. This makes it possible to guarantee that the coolant in the coolant lines in the area from the gas separators to the coolant applying devices—especially in the valves disposed downstream from the gas separators—is present entirely in liquid form and does not form any gas bubbles.

Controllable valves also may be disposed in the first coolant lines. The valves may be embodied as switching valves. This embodiment enables a defined coolant flow to be set in an especially simple manner.

It is possible for the first coolant applying devices to be disposed distributed over the width of the casting roll. In this case the coolant applying devices can especially be activated individually or in groups. This embodiment especially makes it possible to set a defined casting profile in a simple manner.

It is possible for a gap between the first coolant applying devices and the first casting roll and/or an orientation of the first coolant applying devices relative to the first casting roll to be set. This method of operation also enables the cooling power to be set. In particular it is possible for the gap and/or the orientation of the coolant applying devices to be set by a control device in ongoing operation of the roll casting facility.

The cooling medium can especially be liquid nitrogen, a liquid noble gas—especially argon—or an organic coolant.

BRIEF DESCRIPTION OF THE DRAWINGS

The properties, features and advantages described above as well as the manner in which these are achieved will become clearer and more easy to understand in conjunction with the following description of the exemplary embodiments, which are explained in greater detail in conjunction with the drawings of which.

DETAILED DESCRIPTION OF THE PREFERRED EMBODIMENT

Figure 1:
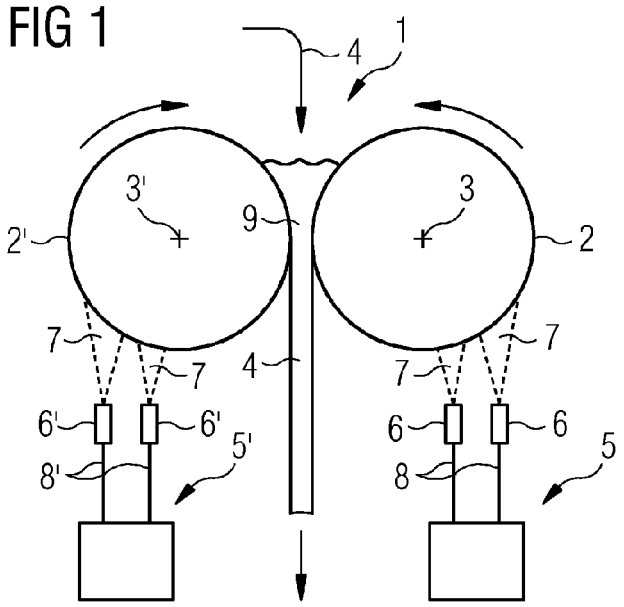
FIG. 1 is a block diagram of a roll casting facility.

Reference will now be made in detail to the preferred embodiments, examples of which are illustrated in the accompanying drawings, wherein like reference numerals refer to like elements throughout.

According to FIG. 1 a roll casting facility has a mold region 1 auf. The mold region 1 is delimited on one side by a first casting roll 2. The first casting roll 2 rotates during operation of the roll casting facility around a first axis of rotation 3. According to FIG. 1 a second casting roll 2' is also present, of which the axis of rotation 3' runs in parallel to the first axis of rotation 3 of the first casting roll 2. The second casting roll 2' rotates during operation in the opposite direction to the first casting roll 2.

In the mold region 1 molten metal 4 is cast. The molten metal 4 solidifies at the edges—especially on the outer surfaces of the casting rolls 2, 2'. The casting rolls 2, 2' rotate from above into the mold region 1. Through this action the metal strand 4' created by solidification of the molten metal 4 is conveyed out of the mold region 1. The metal can be determined as required. For example it can involve steel, aluminum, copper, brass, magnesium etc.

The casting rolls 2, 2' must be cooled. The cooling is often effected by coolant lines which run within the casting rolls 2, 2' (inner cooling). Water is mostly used as the coolant for this inner cooling. The inner cooling is of secondary importance and is therefore not shown in the figure.

As an alternative or in addition to the inner cooling of the casting rolls 2, 2' it is possible to apply a liquid coolant 7 the casting rolls 2, 2' from outside. In this case the roll casting facility has a cooling device 5, 5'—if necessary for each casting roll 2, 2'. The cooling devices 5, 5' each have a number of coolant applying devices 6, 6' (at least one in each case). The liquid coolant 7 is applied by the coolant applying devices 6, 6' from outside to the surface of the respective casting roll 2, 2'.

The coolant applying devices 6, 6' can be embodied as required. In particular they can be embodied as normal spray nozzles, for example as fan spray nozzles, as spherical spray nozzles or as point nozzles. The coolant 7 is supplied to the coolant applying devices 6, 6' via corresponding coolant lines 8, 8' from a reservoir container 7" (see also FIG. 2). A pump 7' can be present, but is not absolutely necessary however.

The coolant 7 is at an operating pressure ρ in the coolant lines 8, 8' and/or in the reservoir container 7". The operating pressure ρ can be equal to the air pressure. As an alternative the operating pressure ρ can be greater than the air pressure, amounting to up to 50 bar for example. As a rule it lies between 10 bar and 30 bar. The coolant 7 is selected so as to have the following properties:

- It is inert in respect of the molten metal 4 (and also the metal strand 4').
- Under normal air pressure it has a boiling point (=standard boiling point) which in any event lies below 20° C. and even below −20° C.
- It has an operating temperature which lies at an operating boiling point of the cooling medium 7 or therebelow. The operating boiling point is related to the operating pressure ρ of the coolant 7.

Examples of suitable coolants 7 are liquid nitrogen, a liquid noble gas (for example argon) and organic coolants. Mixtures of such substances can also be used. For example nitrogen has a standard boiling point of −195.8° C. The operating temperature can for example—at an operating pressure ρ of appr. 20 bar—lie at −190° C. Argon has a standard boiling point of −185.8° C. Its operating temperature can for example—at an operating pressure ρ of appr. 20 bar—lie at −180° C. Fluorinated hydrocarbons are especially considered as organic coolants. A typical example is the coolant R134a (1,1,1,2-Tetrafluorethane). This coolant has a standard boiling point of −26° C. auf. Its operating temperature may be below −30° C., but above −100° C., even above −80° C.

Figure 2:
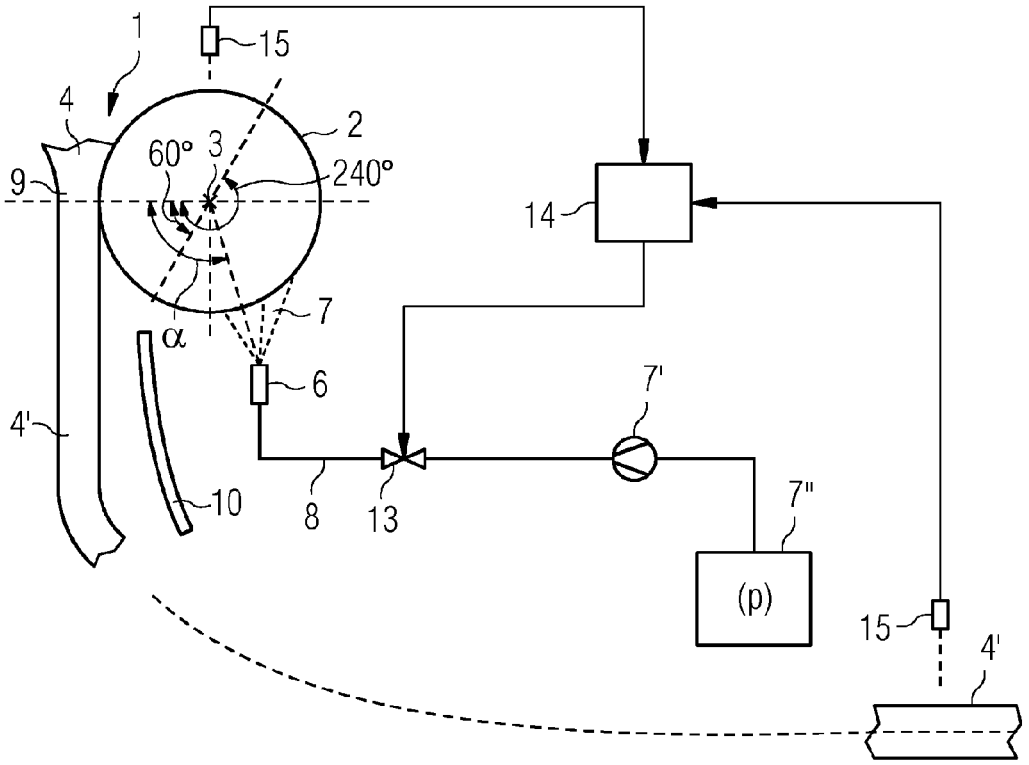
FIG. 2 is a block diagram of a part of the roll casting facility from FIG. 1.

According to FIG. 2—and also according to FIG. 1—the first axis of rotation 3 is oriented horizontally. The second axis of rotation 3' is as a rule located at the same height as the first axis of rotation 3, so that the two axes of rotation 3, 3' lie in a common horizontal plane. Located in this plane is the smallest gap between the two casting rolls 2, 2' (casting gap 9). The metal strand 4' is still conveyed according to FIG. 2 downwards out of the mold region 1.

In this case a significant part of the circumference of the first casting roll 2 is available as the application area. The application area is that location in which the coolant 7 is applied to the surface of the first casting roll 2. An angle $\alpha$, which is related to the first axis of rotation 3, starts from the casting gap 9, is measured in the direction of rotation of the first casting roll 2 and extends to the first application location, can lie for example between 60° and 240°. As a rule the angle $\alpha$ lies between 90° and 180°.

The coolant applying devices 6 for the first casting roll 2 can be disposed next to or—as shown in FIG. 2—below the casting roll 2. The area "below" the first casting roll 2 extends, viewed in the horizontal direction, over the entire diameter of the first casting roll 2. The coolant applying devices 6 for the first casting roll 2 may be spaced away from the metal strand 4' running vertically by at least 25% of the diameter of the first casting roll 2.

In accordance with the method, the coolant applying devices 6 can be disposed in an area of the casting roll facility which is not occupied by other parts and adjusted in any other way. It is therefore possible, according to the diagram of FIG. 2, to arrange a screening device 10—for example a screening plate—between the metal strand 4' and the coolant applying devices 6 for the first casting roll 2. Using the screening device 10 the metal strand 4' can be screened from vaporizing, but still relatively cold, coolant 7 which could otherwise reach the hot metal strand 4. On the other hand the coolant applying devices 6 for the first casting roll 2 and the corresponding coolant lines 8 can be screened against the radiated heat of the still hot metal strand 4'. The screening device 10 can be cooled in its turn, for example by internal water cooling.

Figure 3:
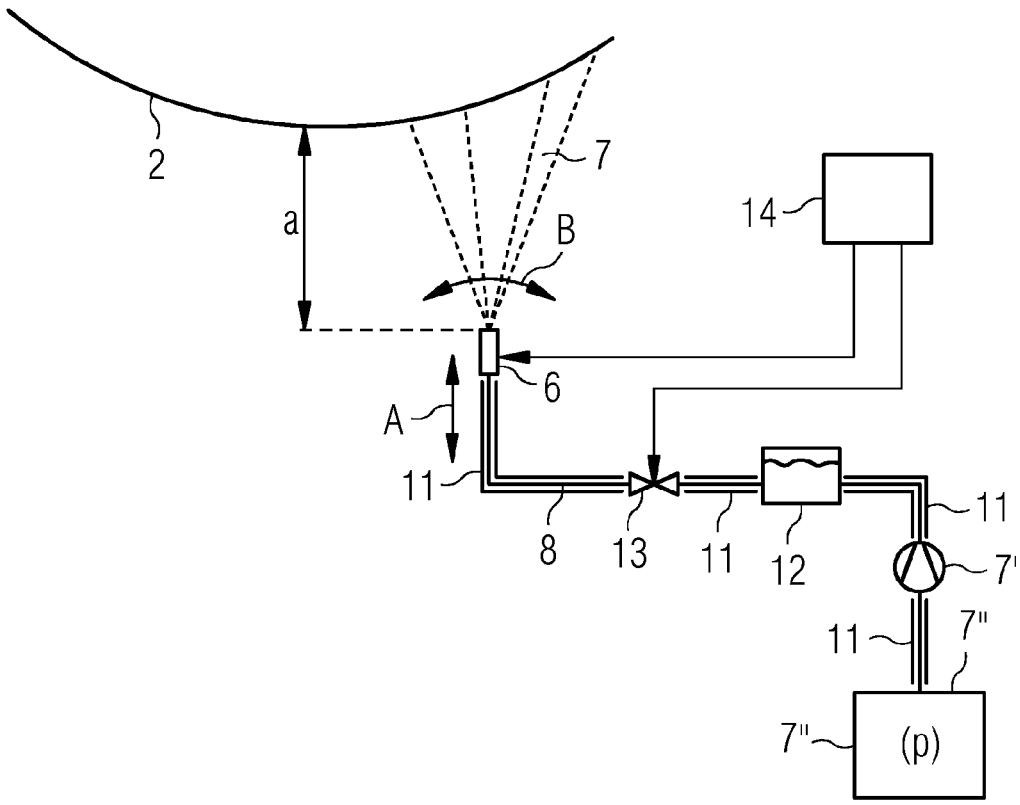
FIG. 3 is a block diagram of a cooling device.

FIG. 3 shows a few further possible embodiments. The embodiments are able to be realized independently of one another.

Thus FIG. 3 shows for example that the coolant lines 8 are jacketed with a thermal insulation 11. Even with relatively long coolant lines 8, this prevents heat entering from the outside heating up the coolant 7 in the coolant lines 8 too greatly.

Furthermore FIG. 3 shows that gas separators 12 are disposed in the coolant lines 8 (or at least one gas separator is disposed there). The gas separators 12 may be disposed shortly before valves 13 which are disposed in coolant lines 8.

The valves 13 can be embodied as proportional valves. The valves may be embodied as switching valves, which are thus either (completely) open or (completely) closed, according to their switching state, see FIG. 4. The valves 13 may be activated by a control device 14, and this is also done during ongoing operation of the roll casting facility.

Figure 4:
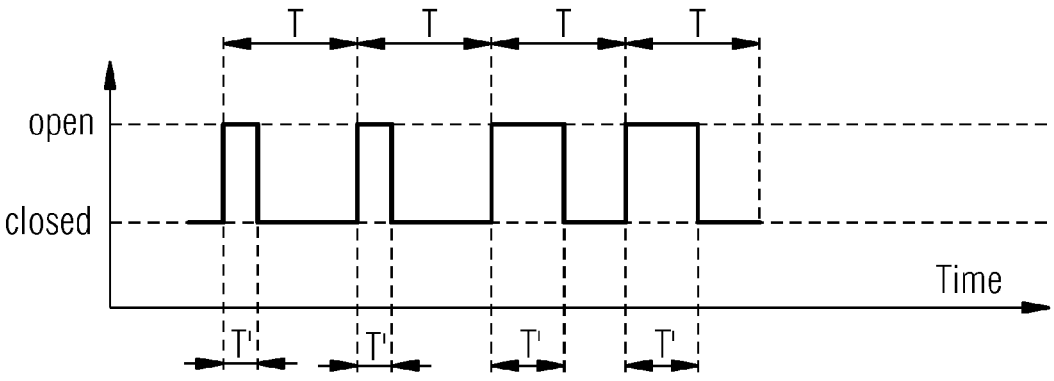
FIG. 4 is a timing diagram and FIG. 5 is a block diagram of a casting roll with coolant applying devices.

In particular, in the event of the valves 13 being embodied as switching valves, the volume of coolant 7 applied on average over time to the first casting roll 2 can be set for example by—similarly to a pulse width modulation—the valves 13 being activated with a fixed clock cycle time T, but within the clock cycle time T however an opening proportion T' being set. Thus, in the left-hand area, FIG. 4 shows an example of an activation state of the valves 13, in which a relatively small amount of coolant 7 is applied to the first casting roll 2, while FIG. 4 in the right-hand part shows an activation state of the valves 13 in which a relatively large amount of coolant 7 is applied to the first casting roll 2.

FIG. 3 also shows that a distance a of the coolant applying devices 6 from the first casting roll 2 is able to be set. This is indicated in FIG. 3 by a corresponding double-ended arrow A. As an alternative or in addition an orientation of the coolant applying devices 6 can be able to be set relative to the first casting roll 2. This is indicated in FIG. 3 by a corresponding double-ended arrow B. The distance a and/or the orientation of the coolant applying devices 6 can also be able to be set by the control device 14—such as while the roll casting facility is operating.

Figure 5:
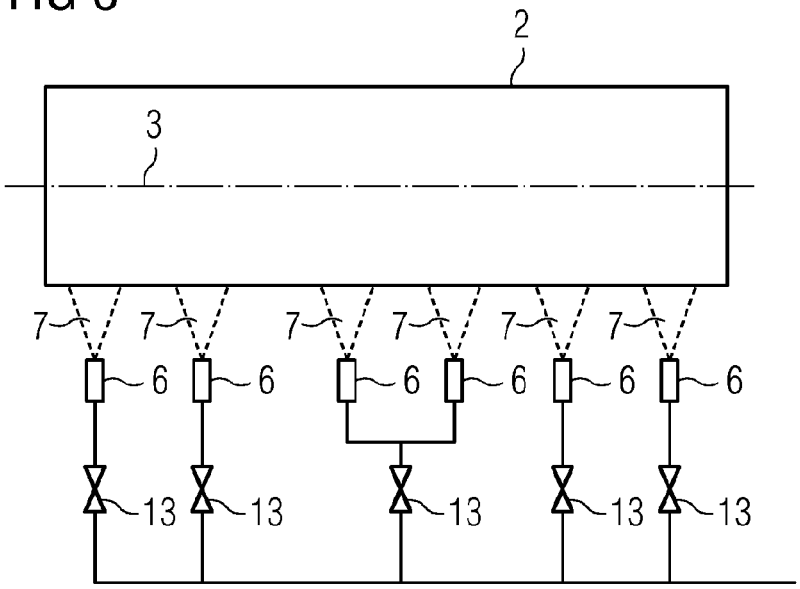

To enable the liquid coolant 7 to be applied to the first casting roll 2 over its entire width a number of coolant applying devices 6 are present as a rule, which are disposed distributed over the width of the first casting roll 2. Purely by way of example six such coolant applying devices 6 are shown in FIG. 5. The number can be greater or smaller, depending on requirements.

It is possible for all coolant applying devices 6 to be controlled jointly. In this case only one valve 13 is required for the coolant applying devices 6. The coolant applying devices 6 may be able to be activated individually—see the two left-hand and the two right-hand coolant applying devices 6 in FIG. 5. As an alternative a number of coolant applying devices 6 in each case—see the two central coolant applying devices 6 in FIG. 5—can be combined into a group which will always be activated in a unified manner as a group (but independently of other groups). In this case it is sufficient for a common valve 13 to be present for each group of coolant applying devices 6.

The cooling of the first casting roll 2 can especially be controlled in a closed loop. In this case the roll casting facility has a least one sensor 15. An actual property of the first casting roll 2 can be detected by the sensor 15 for example. Examples of suitable actual properties are the temperature (possibly as a function of the location viewed in the width direction) and the convexity of the first casting roll 2. As an alternative an actual property of the metal strand 4' can be detected by the sensor 15. Examples of suitable actual properties of the metal strand 4' are especially profile data of the metal strand 4' viewed over the width of the metal strand 4'.

The detected actual property is fed to the control device 14. The control device 14 independently determines, as a function of the actual property fed to it and a corresponding target property, an activation state of the cooling device 5 (for example an activation pattern for the valves 13, for the orientation of the coolant applying devices 6 and/or the distances a between the coolant applying devices 6) and controls the coolant device 5 accordingly.

The second casting roll 2' and its cooling can be designed in a similar manner.

The method has a number of advantages. In particular as a result of the large temperature difference between coolant 7 and (heated-up) casting rolls 2, 2' and the phase transition on vaporization of the coolant 7, a high cooling power can be achieved. Because of the fact that the coolant 7 is inert, it can also be used to form an inert atmosphere within the roll casting facility. Because of the fact that the coolant 7' vaporizes completely before the casting rolls 2, 2' come into contact again with the hot molten metal 4, no wiper, suction or other type of removal devices are required for the coolant 7.

Although the method has been illustrated and described in greater detail by the exemplary embodiment, the method is not restricted by the disclosed examples and other variations can be derived therefrom by the person skilled in the art without departing from the scope of protection provided by the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A roll casting method, comprising:

casting molten metal in a mold region delimited on a first side by a first casting roll rotating around a horizontal first axis of rotation;

conveying a metal strand, created by solidification of the molten metal, out of the mold region;

applying a liquid coolant to a surface of the first casting roll by a first cooling device via first coolant applying devices receiving the liquid coolant via first coolant lines, the liquid coolant being inert in respect of the molten metal and having a standard boiling point at normal air pressure of below 20° C. and an operating temperature at or below an operating boiling point related to an operating pressure applied to the liquid coolant;

detecting an actual property of the first casting roll by a first sensor configured to observe a section of the first casting roll before the section makes contact with the molten metal and after the section has received the coolant in a rotation cycle of the first casting roll; and controlling the first cooling device by a control device determining, for each of a plurality of periodic cycles of a clock cycle time, a proportion of activation time of the first cooling device in the clock cycle time, as a function of the actual property and a corresponding target property, and activating the first cooling device accordingly throughout the cycles, the control device controlling the first cooling device such that the liquid coolant, after being applied to a surface portion of the first casting roll, is substantially entirely vaporized from the casting roll prior to the surface portion making next contact with the molten metal.

2. The roll casting method as claimed in claim 1, wherein the mold region is delimited on a second side by a second casting roll rotating around a second horizontal axis of rotation parallel to the first axis of rotation, wherein the first and the second casting rolls have a casting gap therebetween, and wherein the metal strand is conveyed downwards out of the mold region and an angle of between 60° and 180° is formed through the first axis of rotation from a casting gap of the mold region to an application location at which the liquid coolant is applied to the surface of the first casting roll.

3. The roll casting method as claimed in claim 2, wherein the first casting roll has a diameter, and wherein the first coolant applying devices are disposed below a lowest point of the first casting roll in an area extending over the diameter the first casting roll.

4. The roll casting method as claimed in claim 2, wherein the angle is between 90° and 180°.

5. The roll casting method as claimed in claim 3, further comprising thermally screening at least one of the metal strand against the liquid coolant and the first coolant applying devices from the metal strand by a screening device disposed between the metal strand and the first coolant applying devices.

6. The roll casting method as claimed in claim 5, wherein the first coolant lines are jacketed with a thermal insulation.

7. The roll casting method as claimed in claim 6, wherein gas separators are disposed in the first coolant lines.

8. The roll casting method as claimed in claim 7, wherein controllable switching valves are disposed in the first coolant lines.

9. The roll casting method as claimed in claim 8, wherein the first coolant applying devices are distributed over the diameter of the first casting roll and are activated one of individually and in groups.

10. The roll casting method as claimed in claim 9, further comprising setting at least one of a gap between the first coolant applying devices and the first casting roll and an orientation of the first coolant applying devices relative to the first casting roll.

11. The roll casting method as claimed in claim 10, further comprising setting, by the control device during operation, at least one of a distance and an orientation of the first coolant applying devices relative to the first casting roll.

12. The roll casting method as claimed in claim 11, wherein the liquid coolant is selected from the group consisting of liquid nitrogen, a liquid noble gas and an organic coolant.

13. The roll casting method as claimed in claim 12, wherein the liquid coolant is liquid argon.

14. The roll casting method as claimed in claim 1, wherein the standard boiling point of the liquid coolant at normal air pressure is below −20° C.

* * * * *